US009523063B2

(12) United States Patent
Hurst et al.

(10) Patent No.: US 9,523,063 B2
(45) Date of Patent: Dec. 20, 2016

(54) STACKABLE SEGMENTED CANDLE SYSTEM AND METHOD OF USE

(71) Applicants: Natalie Hurst, Larkspur, CO (US); Roger Hurst, Larkspur, CO (US)

(72) Inventors: Natalie Hurst, Larkspur, CO (US); Roger Hurst, Larkspur, CO (US)

( * ) Notice: Subject to any disclaimer, the term of this patent is extended or adjusted under 35 U.S.C. 154(b) by 368 days.

(21) Appl. No.: 14/055,881

(22) Filed: Oct. 17, 2013

(65) Prior Publication Data

US 2014/0134554 A1 May 15, 2014

Related U.S. Application Data

(60) Provisional application No. 61/724,903, filed on Nov. 9, 2012.

(51) Int. Cl.
*C11C 5/00* (2006.01)
*C11C 5/02* (2006.01)

(52) U.S. Cl.
CPC ..... *C11C 5/008* (2013.01); *C11C 5/023* (2013.01)

(58) Field of Classification Search
CPC ..... F23D 3/16
USPC ..... 431/288, 289
See application file for complete search history.

(56) References Cited

U.S. PATENT DOCUMENTS

| | | | | |
|---|---|---|---|---|
| 3,388,960 | A * | 6/1968 | Cangialosi | C11O 5/008 431/126 |
| 3,826,606 | A | 7/1974 | Hicks | |
| 6,203,313 | B1 * | 3/2001 | Holmes | F23D 3/16 431/288 |
| 6,508,644 | B1 | 1/2003 | Pesu et al. | |
| 6,551,099 | B1 | 4/2003 | Kapinski | |
| 6,769,905 | B2 | 8/2004 | Gray et al. | |
| 6,793,484 | B2 | 9/2004 | Pesu et al. | |
| 7,040,888 | B2 | 5/2006 | Keiffer | |
| 7,578,670 | B2 | 8/2009 | Keiffer | |
| 7,798,808 | B2 | 9/2010 | Kleve | |
| 8,206,150 | B2 | 6/2012 | Wade | |
| 2005/0214704 | A1 * | 9/2005 | Pappas | F23D 3/16 431/126 |
| 2006/0292509 | A1 | 12/2006 | Reisman | |
| 2008/0070174 | A1 * | 3/2008 | Moeller | C11O 5/008 431/289 |
| 2008/0268391 | A1 | 10/2008 | McShane | |

* cited by examiner

*Primary Examiner* — Avinash Savani
(74) *Attorney, Agent, or Firm* — Shannon L Warren

(57) ABSTRACT

A candle segment comprising a portion of a layered candle. Said candle segment comprises a candle wick, a top surface, a bottom surface, and a height. Said candle segment comprises a one or more protruding studs and a one or more stud cavities. Said one or more protruding studs and said one or more stud cavities are on opposite sides of said candle segment at said top surface and said bottom surface.

18 Claims, 13 Drawing Sheets

STACKABLE SEGMENTED CANDLE SYSTEM AND METHOD OF USE

BACKGROUND

This disclosure relates generally to a stackable layered candle system and method of use. For more information on layered candles can be found in U.S. Pat. No. 7,040,888, U.S. Pat. No. 7,578,670, U.S. Pat. No. 7,789,808, US Patent Application Number 2006/0292509, and US Patent Application Number 2008/0268391. None of the disclosed inventions and patents, taken either singularly or in combination, is seen to describe the instant disclosure as claimed. Accordingly, an improved layered candle would be advantageous.

SUMMARY

A candle segment, a two or more candle segments and a candle segment manufacturing method are disclosed.

Said candle segment comprising a portion of a layered candle. Said candle segment comprises a candle wick, a top surface, a bottom surface, and a height. Said candle segment comprises a one or more protruding studs and a one or more stud cavities. Said one or more protruding studs and said one or more stud cavities are on opposite sides of said candle segment at said top surface and said bottom surface.

Said two or more candle segments comprising a layered candle. Said two or more candle segments comprise a first candle segment and a second candle segment. Said two or more candle segments each comprise a candle wick, a top surface, a bottom surface, a height and a composition. A bottom surface of said first candle segment is capable of attaching a top surface of said second candle segment.

Said candle segment manufacturing method comprising: attaching a first end of an extended candle wick around a rod, attaching a second end of said extended candle wick to a post of a candle tab, placing said candle tab at a bottom of a container while keeping said rod with said first end of said extended candle wick at the top of said container, pouring a liquid wax into said container, molding said a first candle segment form said liquid wax, said candle tab and said wick, and removing said first candle segment from said container when said liquid wax solidifies. Said first candle segment comprises a top surface and a bottom surface. Said first candle segment comprises a portion of a two or more candle segments comprising a layered candle. A bottom surface of said first candle segment is formed so as to nest into a top surface of a second candle segment among said two or more candle segments.

BRIEF DESCRIPTION OF THE DRAWINGS

FIG. 7A comprises said layered candle in an assembled configuration and FIGS. 7B-7C comprises said layered candle in an exploded configuration.

DETAILED DESCRIPTION

Described herein is a stackable layered candle system and method of use. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
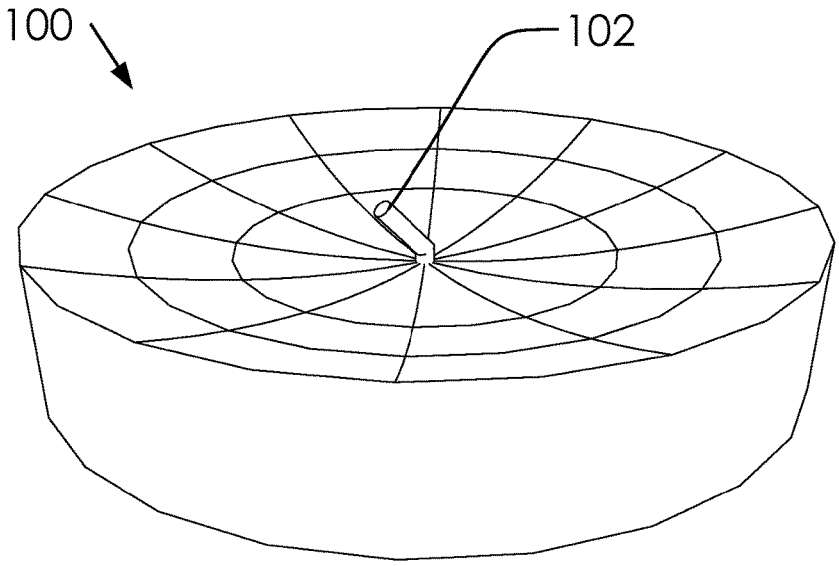
FIG. 1A illustrates a perspective overview of a candle segment and a candle wick.

FIG. 1A illustrates a perspective overview of a candle segment 100 and a candle wick 102. In one embodiment, said candle segment 100 can comprise various sizes and compositions. In one embodiment, said compositions can comprise different colors as well as a variety of scents. In one embodiment, said candle segment 100 can be substantially cylindrical in shape but can be formed into various polygonal shapes as desired. In one embodiment, said candle segment 100 can be made of various types of waxes, including but not limited to, beeswax, soy, plant waxes, tallow, and gel. In one embodiment, said candle wick 102 is embedded centrally within said candle segment 100 with a section of said candle wick 102 exposed on the top of said candle segment 100 used for lighting said candle wick 102. In one embodiment, said candle wick 102 can comprise a flat braided wick, a round braided wick, a square braided wick, a cored wick, a wooden wick, a specialty wick and/or a similar wick type as known in the art.

Figure 1B:
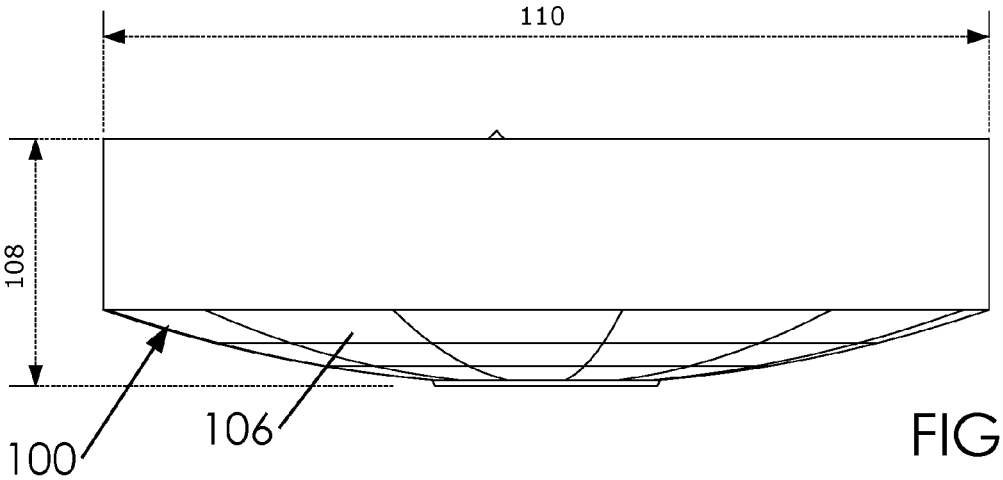
FIGS. 1B and 1C illustrate a side view and top view of said candle segment, respectively.
Figure 1C:
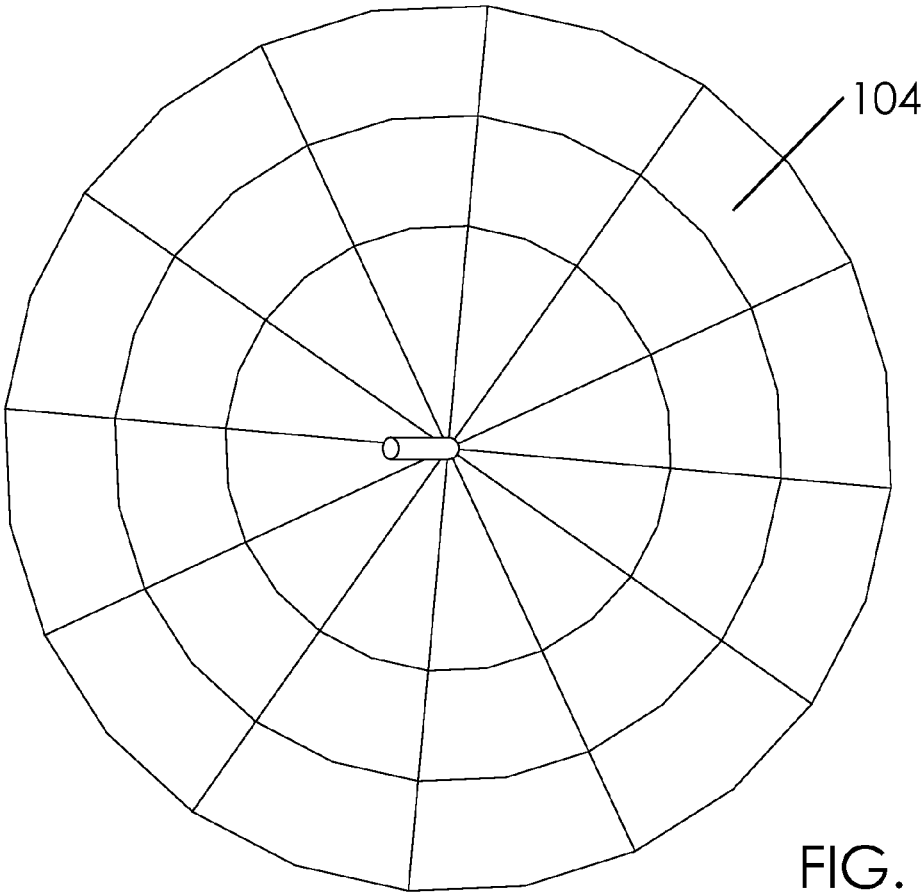

FIGS. 1B and 1C illustrate a side view and top view of said candle segment 100, respectively. In one embodiment, said candle segment 100 can comprise a top surface 104, a bottom surface 106, a height 108, and a diameter 110. In one embodiment, said height 108 and said diameter 110 can vary to result in different candle sizes and proportions as desired. In one embodiment, said height 108 and composition can be chosen so that said candle segment 100 will burn for a specific period of time. In one embodiment, said top surface 104 can have a concave shape while said bottom surface 106 can have a convex shape. In one embodiment, said top surface 104 and said bottom surface 106 can be similarly angled to permit nesting of said surfaces if one or more of said candle segment 100 was to be stacked on one another. In one embodiment, said surfaces can enhance said candle segment 100 aesthetics while providing a more stable foundation for nesting purposes.

Figure 1D:
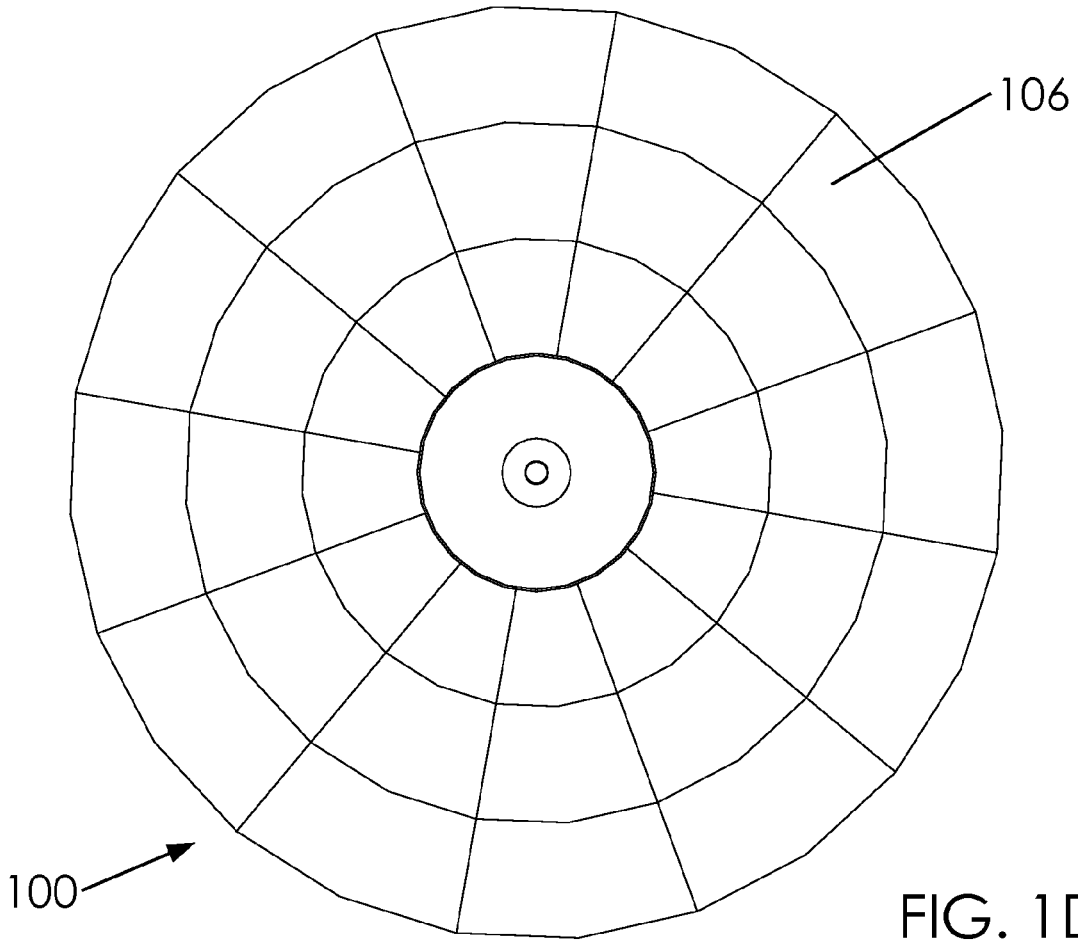
FIGS. 1D and 1E illustrate a bottom view and a perspective bottom view of said candle segment respectively.
Figure 1E:
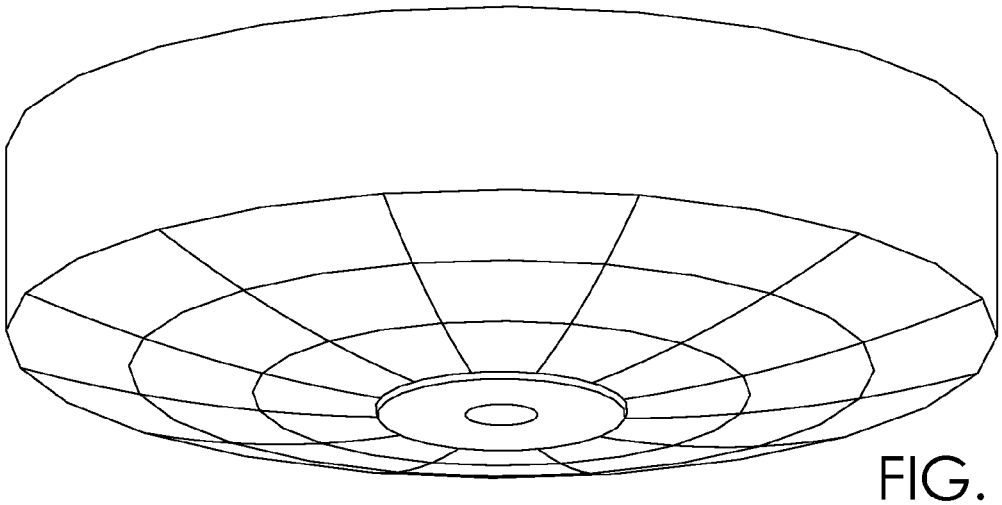

FIGS. 1D and 1E illustrate a bottom view and a perspective bottom view of said candle segment 100 respectively.

Figure 2A:
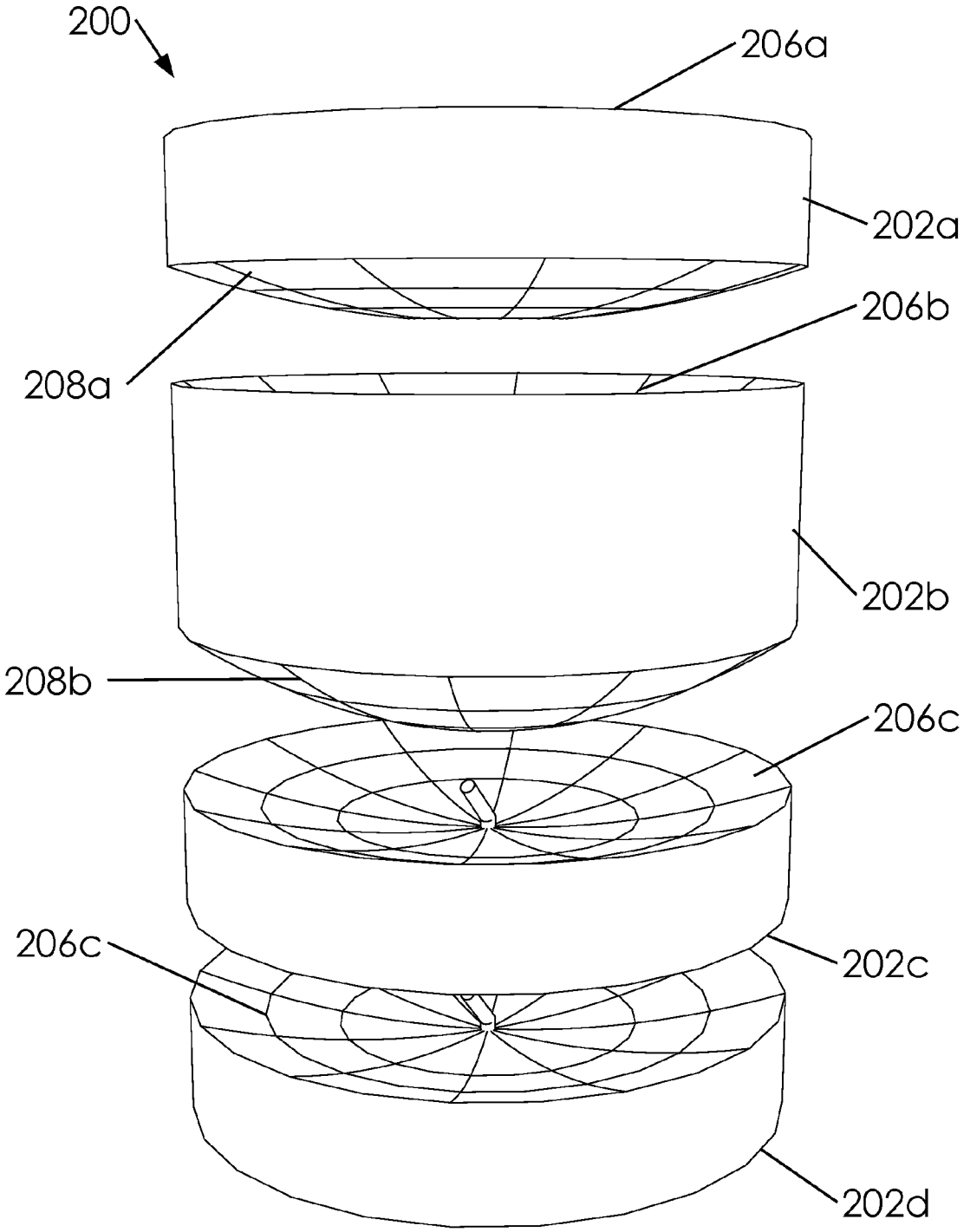
FIG. 2A illustrates a perspective exploded overview of a layered candle.

FIG. 2A illustrates a perspective exploded overview of a layered candle 200. In one embodiment, said layered candle 200 can comprise of a one or more layered candle segments. In one embodiment, said one or more layered candle segments can comprise a segment 202*a*, a segment 202*b*, a segment 202*c* and a segment 202*d*. In one embodiment, more or less of said one or more layered candle segments may be used. In one embodiment, said layered candle 200 can comprise one or more of said candle segment 100 (such as said segment 202*a*, said segment 202*b*, and said segment 202*c*) and a base segment (such as said segment 202*d*). In one embodiment, said one or more candle segments can be rearranged as desired (such as placing said candle segment 202*a* in place of said candle segment 202*b* and vice versa). In one embodiment, said segment 202*d* can comprise a concave top surface and a flat bottom surface. Thus, in one embodiment, said base segment (or, as here, said segment 202*d*) can create a stable footing for said layered candle 200 (when they are stacked). In another embodiment, said candle segment 100 can comprise a convex bottom surface and can be set into a stable base with a concave top surface. For example, in one embodiment, said layered candle 200 can further comprise a candle holder having a concave top surface capable of holding said layered candle 200 comprising a convex bottom surface.

Although not illustrated, it would be apparent to one of ordinary skill in the art that the said candle segment 100 and said layered candle 200 could work equally well by reversing the concave and convex portions.

In one embodiment, each of said segment 202*a*, said segment 202*b*, and said segment 202*c* can comprise a top surface with a concave shape and a bottom surface with a convex shape. In one embodiment, said segment 202*a* can comprise a top surface 206*a* and a bottom surface 208*a*. In one embodiment, said segment 202*b* can comprise a top surface 206*b* and a bottom surface 208*b*. In one embodiment, said segment 202*c* can comprise a top surface 206*c* and a bottom surface 208*c* (see both FIGS. 2A and 2D for illustrations of these components). In one embodiment, said bottom surface 208*a* of said segment 202*a* can rest on said top surface 206*b* of said segment 202*b*. In one embodiment, said bottom surface 208*b* of segment 202*b* can rest on said top surface 206*c* of said segment 202*c*. In one embodiment, said bottom surfaces can be mated to said top surfaces in series to form said layered candle 200 of various heights.

Figure 2B:
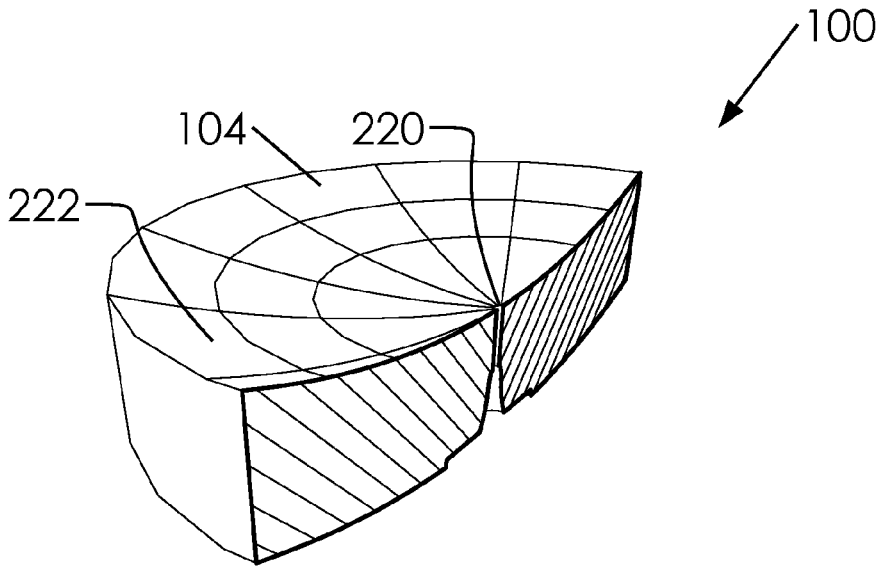
FIGS. 2B and 2C illustrate a perspective overview and an elevated side view of a section cut of said candle segment.
Figure 2C:
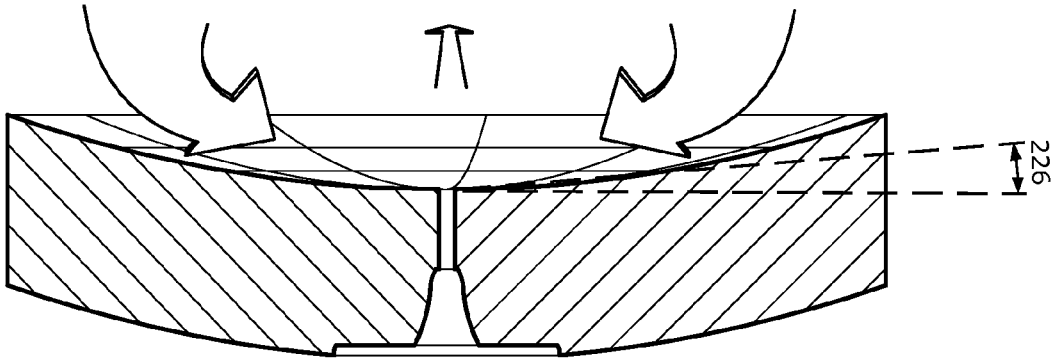

FIGS. 2B and 2C illustrate a perspective overview and an elevated side view of a section cut of said candle segment 100. In one embodiment, said top surface 104 of said candle segment 100 can comprise a center-point 220 and an upper wall surface 222. In one embodiment, as said candle segment 100 melts, wax from said upper wall surface 222 will drain toward said center-point 220. In one embodiment, said top surface 104 can comprise an incline 226 of said upper wall surface 222 in said concave portion of said top surface 104. In one embodiment, said incline 226 can be low enough to control a flow of said wax as it melts into said center-point 220. Accordingly, said wax can have sufficient time to burn off without extinguishing a flame at said candle wick 102.

Figure 2D:
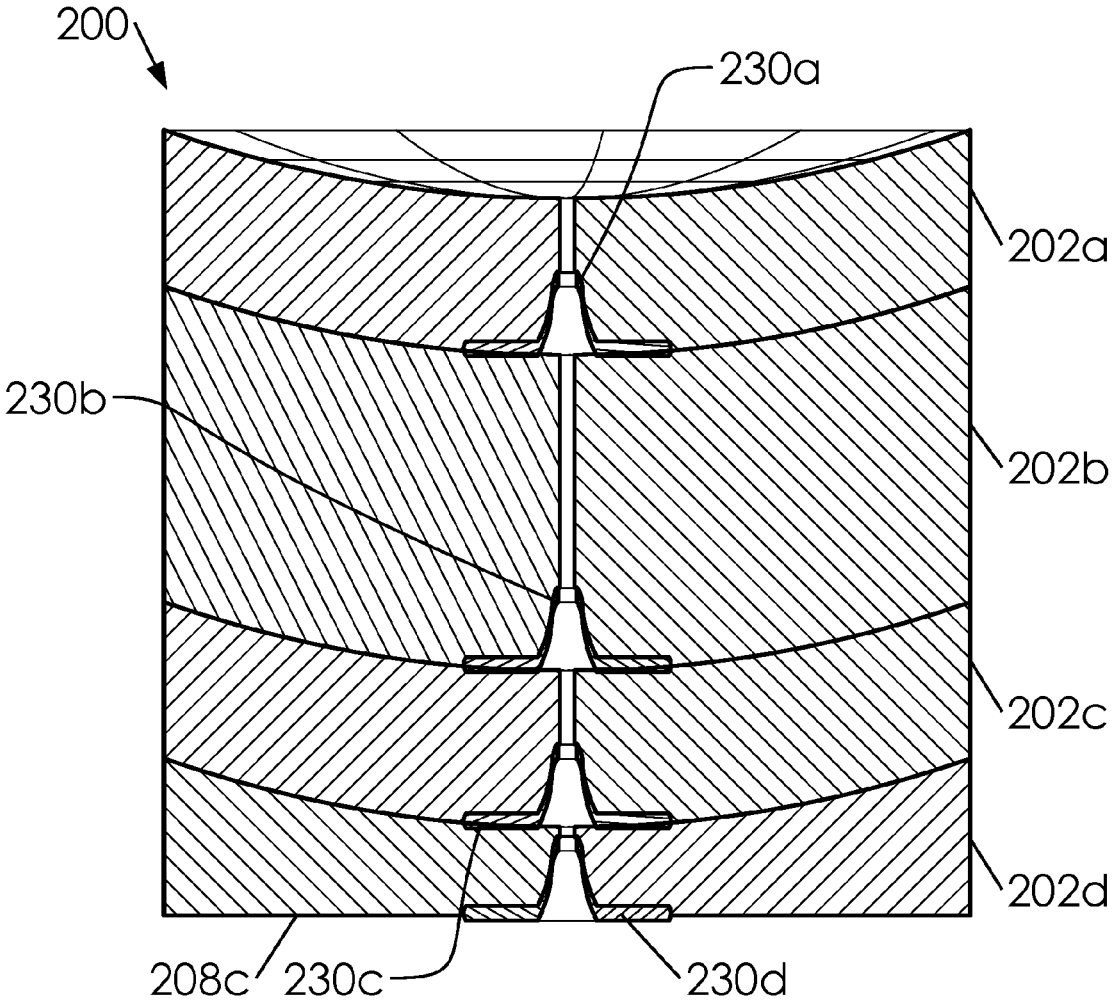
FIG. 2D illustrates an elevated side cross-section of said stack of candle segments.

FIG. 2D illustrates an elevated side cross-section of said layered candle 200. FIG. 2D is presented with candle wicks hidden (a discussion of candle wicks is included below). In one embodiment, said segment 202*a* can comprise a tab 230*a*; said segment 202*b* can comprise a tab 230*b*; said segment 202*c* can comprise a tab 230*c*; and said segment 202*d* can comprise a tab 230*d*. In one embodiment, as said segment 202*a* is burning out, it will burn down to said tab 230*a* and stop. Thus, in one embodiment said tab 230*a* (as with the other tabs described herein) can comprise a firewall. This trend can continue such that a user of said layered candle 200 may light a first among said layered candle 200 and minimize the risk that said user will forget to extinguish said layered candle 200 and thereby burn through the supply of wax in said layered candle 200. It is therefore advantageous to break a candle into segments, as has been done with said layered candle 200.

Figure 3A:
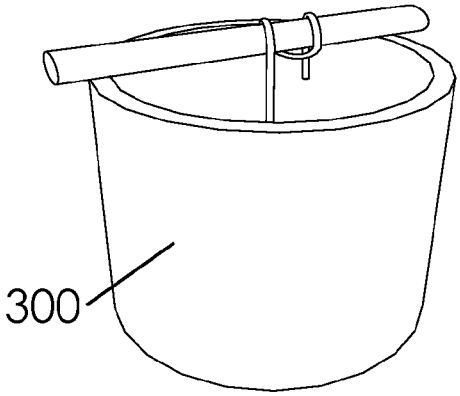
FIGS. 3A, 3B, and 3C illustrate a perspective overview, a perspective top view and a perspective cross-section side view of a container, a rod, an extended candle wick, and a candle tab, respectively.
Figure 3B:
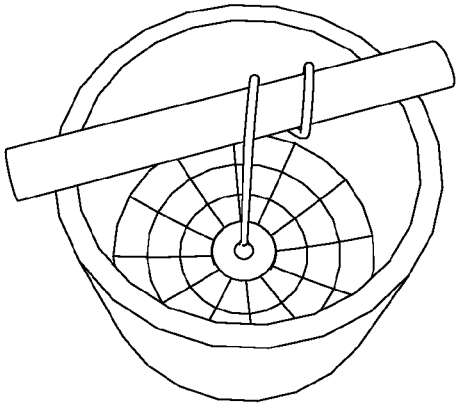
Figure 3C:
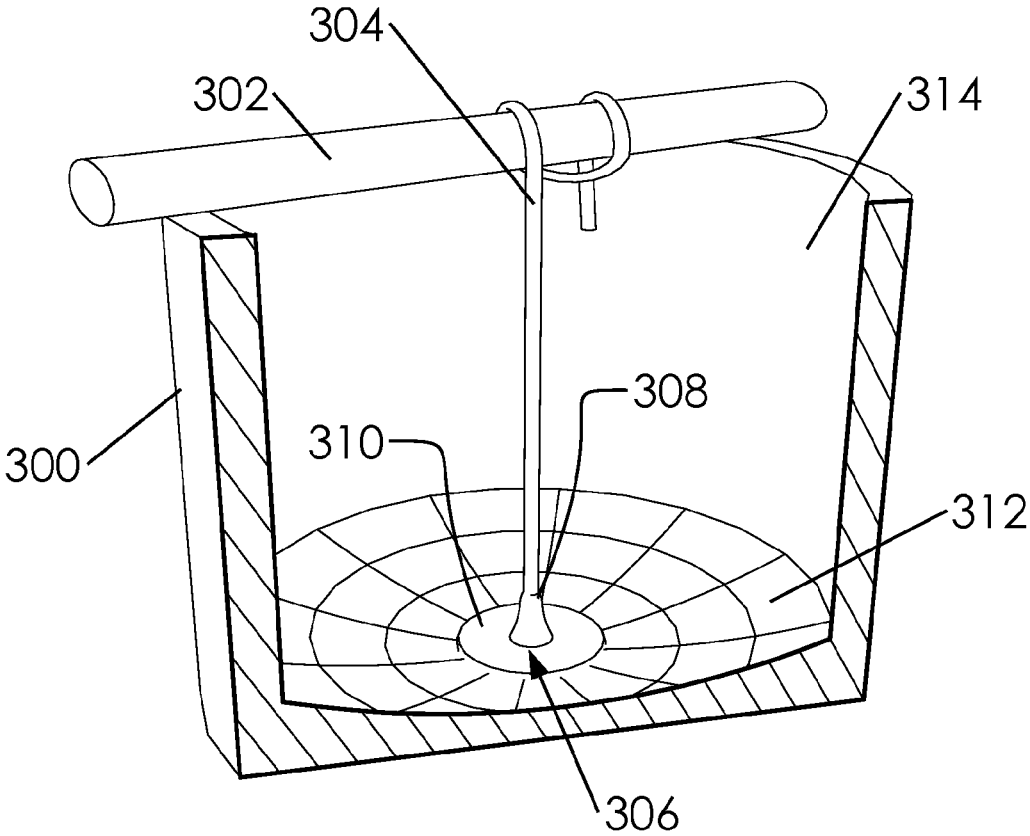

FIGS. 3A, 3B, and 3C illustrate a perspective overview, a perspective top view and a perspective cross-section side view of a container 300, a rod 302, an extended candle wick 304, and a candle tab 306, respectively. In one embodiment, said tab 230*a*, said tab 230*b*, said tab 230*c* and said tab 230*d* (as shown in FIG. 2D) can comprise one of said candle tab 306. In one embodiment, said candle tab 306 can comprise a post 308 and a base 310. In one embodiment, said post 308 can be located centrally on said base 310. In one embodiment, said post 308 can be hollow to permit said candle wick 102 or other wicks to pass through (see infra) In one embodiment, said candle tab 306 can be used during formation of said candle segments as a wick stabilizer and as an endpoint for a burning wick. In one embodiment, said candle tab 306 can be used as a separator between one or more candle segments. In one embodiment, said candle tab 306 can comprise a firewall between said one or more candle segments.

In one embodiment, making said candle segment 100 can be formed in said container 300 by: attaching a first end of said extended candle wick 304 around said rod 302, attaching a second end of said extended candle wick 304 to said post of said candle tab 306, and pouring a liquid wax into said container 300.

In one embodiment, said container 300 can comprise a lower surface 312 and a sidewall 314. In one embodiment, said lower surface 312 can be concave and capable of molding said convex portion of said candle segment 100.

Figure 4:
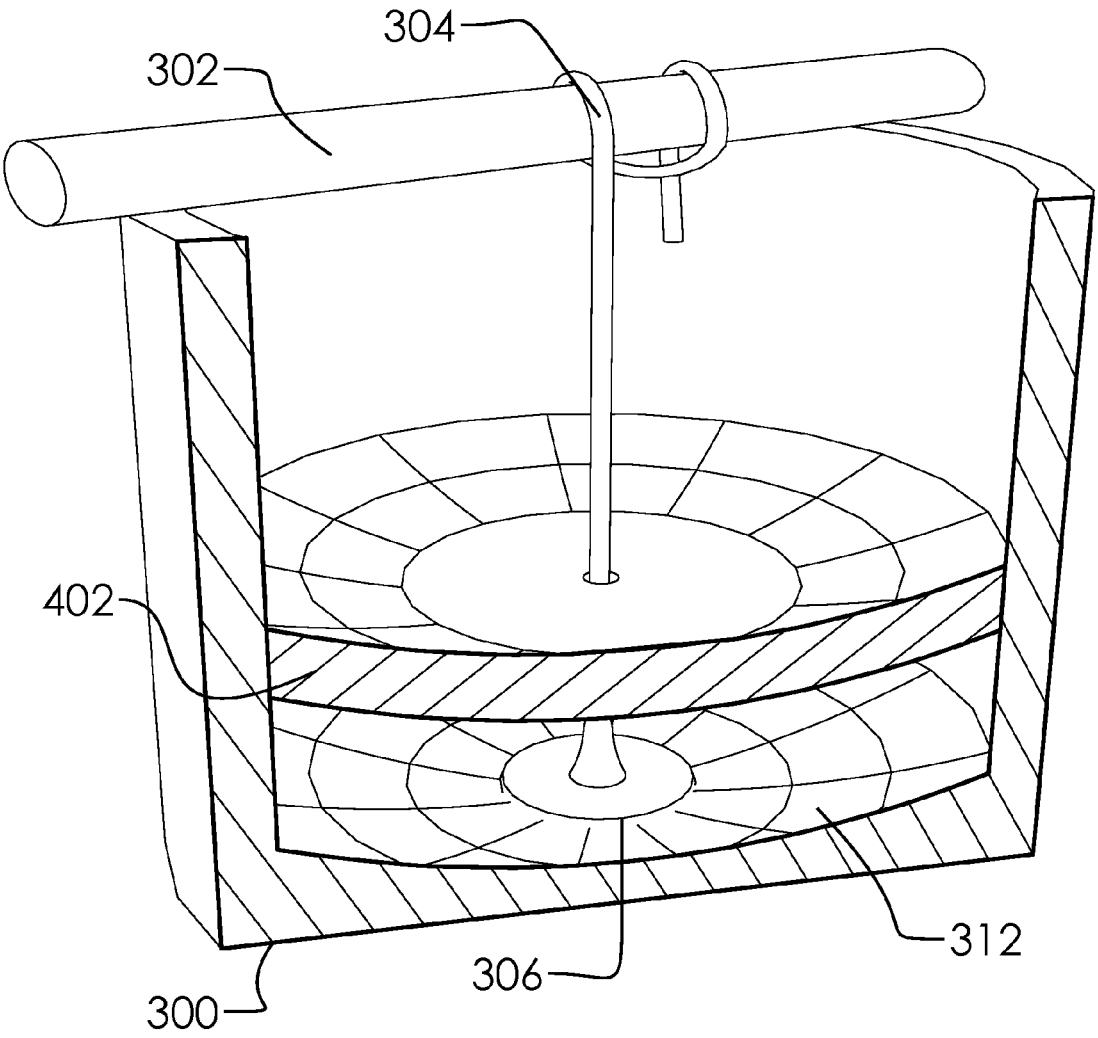
FIG. 4 illustrates a perspective sectional side view of a container, a rod, an extended candle wick, an upper cast, a lower surface, and said candle tab, respectively.
Figure 5A:
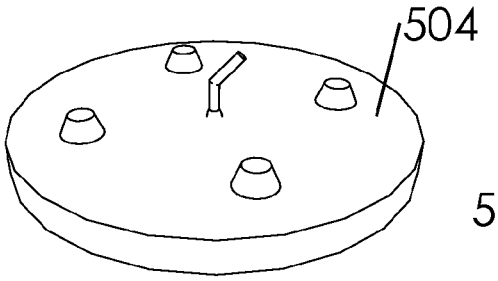
FIGS. 5A, 5B, 5C and 5D illustrate a perspective overview, a perspective bottom view, an elevated top view and an elevated side view of an alternative candle segment 500.
Figure 5B:
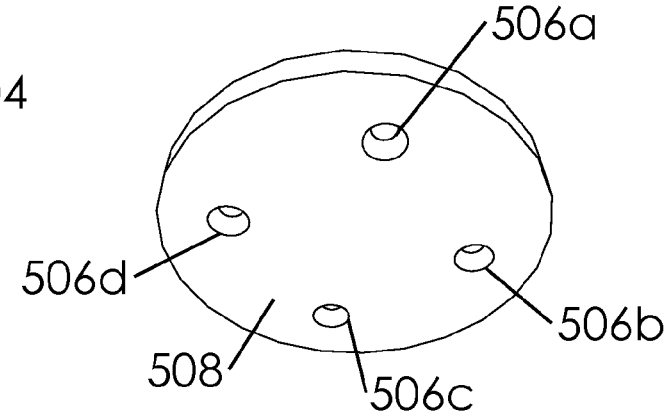
Figure 5C:
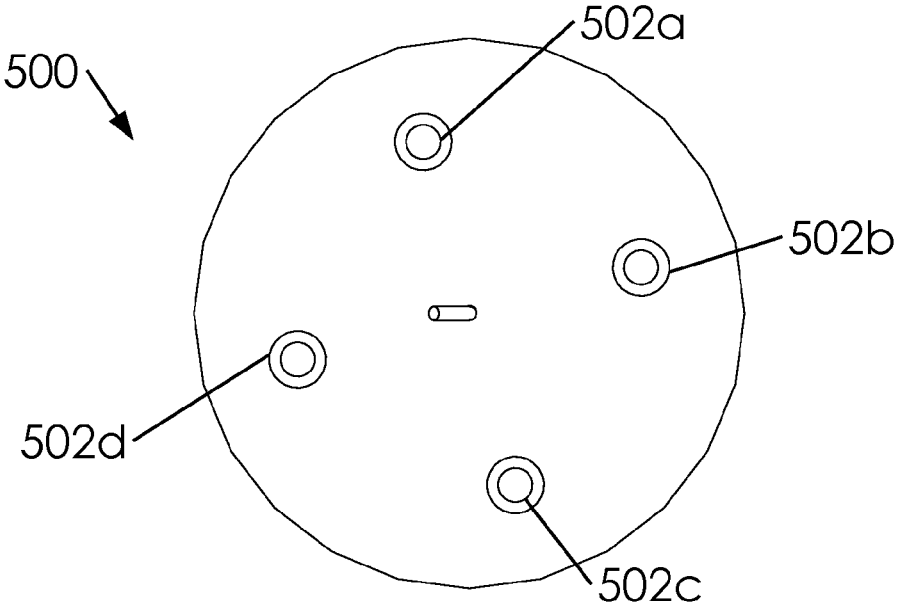
Figure 5D:
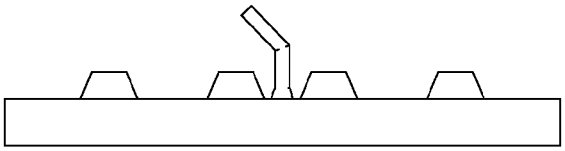
Figure 6A:
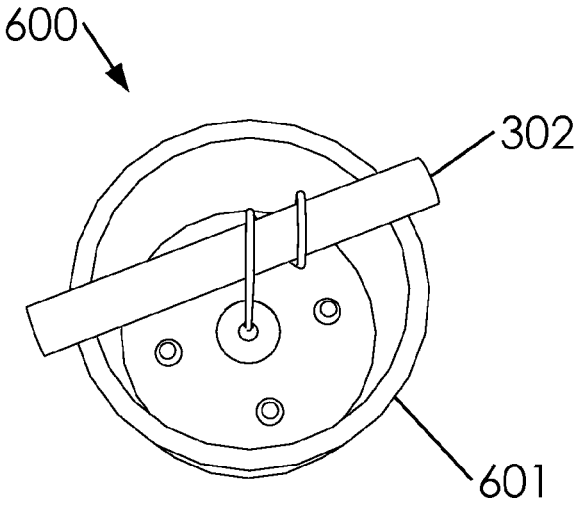
FIGS. 6A, 6B, 6C and 6D illustrate a perspective overview, a perspective front side view, and two a sectional side views of a candle making assembly.
Figure 6B:
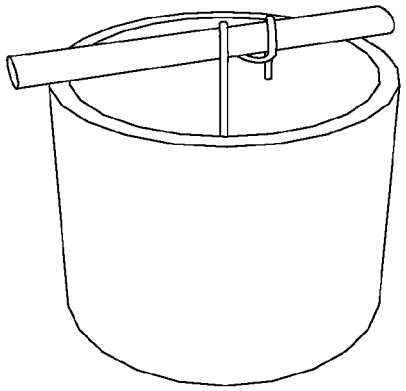
Figure 6C:
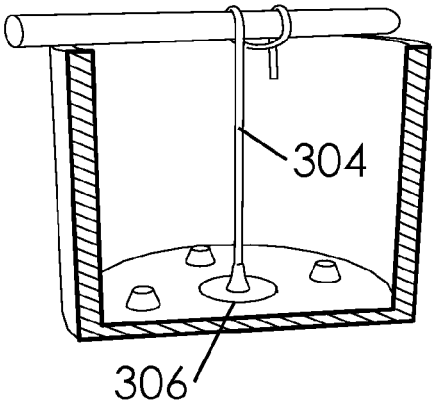
Figure 6D:
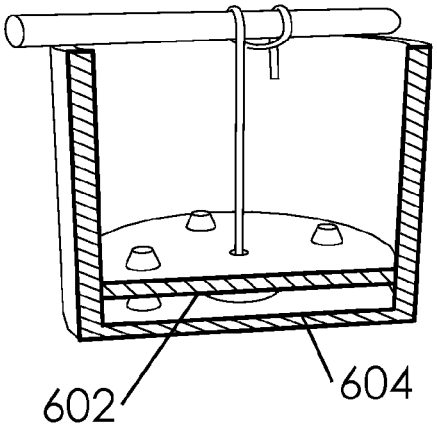

FIG. 4 illustrates a perspective sectional side view of a container 300, a rod 302, said extended candle wick 304, an upper cast 402, a lower surface 312, and said candle tab 306, respectively. In one embodiment, one or more of said candle tab 306, said upper cast 402, and said lower surface 312 can be arranged along the length of said extended candle wick 304. In one embodiment, said extended candle wick can be suspended by said rod 302 within said container 300. In one embodiment, once one or more of said candle tab 306, said upper cast 402, and said lower surface 312 are arranged in a desired position within said container 300, wax can be poured into said container to form one or more of said candle segment 100. In one embodiment, different types of scents, colors, or waxes can be used for one or more of said candle segment 100. Once formation is complete, one or more of said candle segment 100 can be removed from said container 300 and separated accordingly. In one embodiment, one or more of said candle segment 100 can be rearranged to satisfy desired scent, color, or height preference.

FIGS. 5A, 5B, 5C and 5D illustrate a perspective overview, a perspective bottom view, an elevated top view and an elevated side view of an alternative candle segment 500. In one embodiment, said alternative candle segment 500 can comprise one or more protruding studs, a top surface 504, one or more stud cavities, and a bottom surface 508. In one embodiment, said top surface 504 can comprise of said one or more protruding studs. In one embodiment, said bottom surface 508 can comprise said one or more stud cavities. In one embodiment, said one or more protruding studs can comprise a first stud 502*a*, a second stud 502*b*, a third stud 502*c* and a fourth stud 502*d*. In one embodiment, said one or more stud cavities can comprise a first cavity 506*a*, a second cavity 506*b*, a third cavity 506*c* and a fourth cavity 506*d*. In one embodiment, said alternative candle segment 500 can comprise an equal number of said one or more protruding studs and said one or more stud cavities. In one embodiment, said one or more protruding studs can be in said bottom surface 508 and said one or more stud cavities can be in said top surface 504 (not illustrated here). In one embodiment, said one or more of said stud cavity 506 is arranged so that said alternative candle segment 500 can stack upon one another to permit said top surface 504 to make contact with said bottom surface 508 of another of said alternative candle segment 500. In one embodiment, one or more of said alternative candle segment 500 may be stacked in this manner. Thus, in one embodiment said one or more of said alternative candle segment 500 can interlock onto one another.

FIGS. 6A, 6B, 6C and 6D illustrate a perspective overview, a perspective front side view, and two a sectional side views of a candle making assembly 600. In one embodiment, said candle making assembly 600 can comprise a container 601, said rod 302, said extended candle wick 304, an upper alternative cast 602, and an alternative lower cast 604, and said candle tab 306. In one embodiment, said candle making assembly 600 can be used to make one or more of said alternative candle segment 500. In one embodiment, said alternative candle segment 500 can be made in a substantially similar way to said candle segment 100 (see supra) with said alternative candle segment 500.

In one embodiment, one or more of said alternative candle segment 500 can be stacked according to scent, color, size, desired height, or any other specification as desired.

Figure 7A:
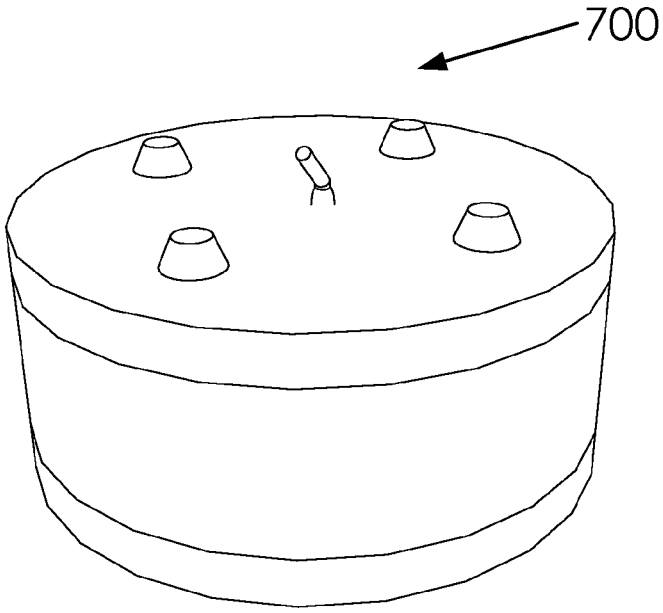
FIGS. 7A, 7B and 7C illustrate three perspective overviews of a layered candle.
Figure 7B:
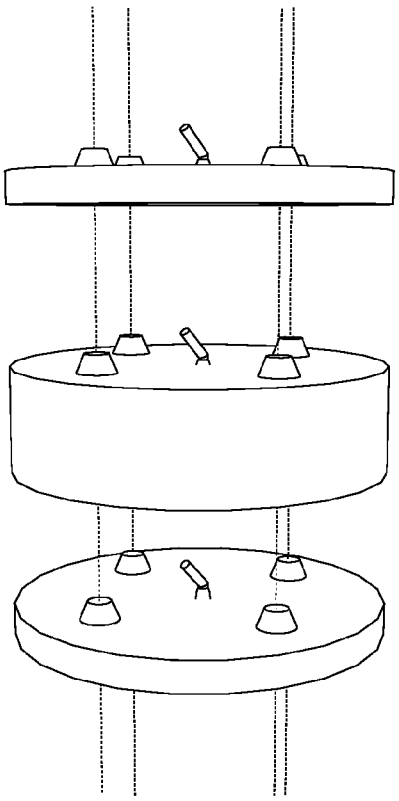
Figure 7C:
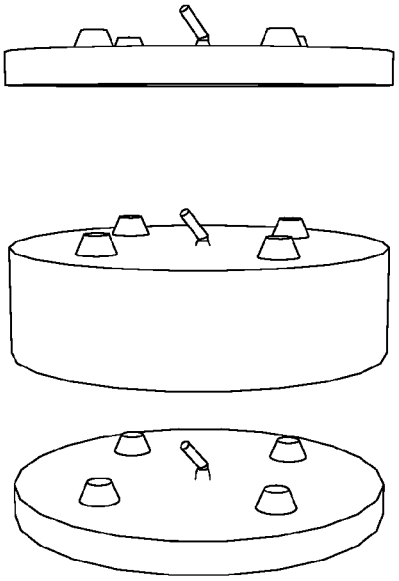

FIGS. 7A, 7B and 7C illustrate three perspective overviews of a layered candle 700. FIG. 7A comprises said layered candle 700 in an assembled configuration and FIGS. 7B-7C comprises said layered candle 700 in an exploded configuration. In one embodiment, said layered candle 700 can comprise a plurality of said alternative candle segment 500.

Figure 8A:
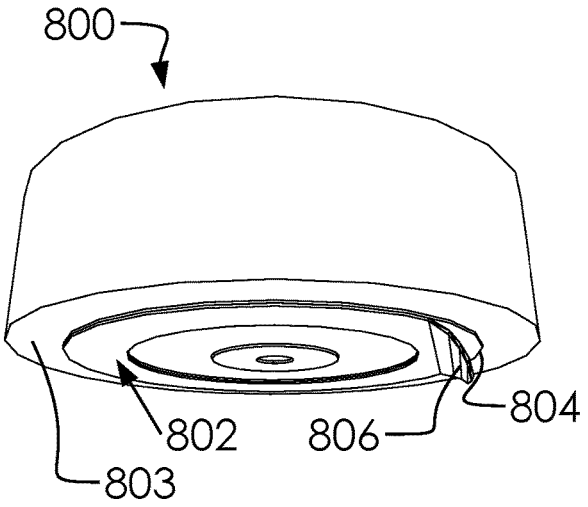
FIGS. 8A, 8B and 8C illustrate three perspective lower views of a candle segment and a second segment.
Figure 8B:
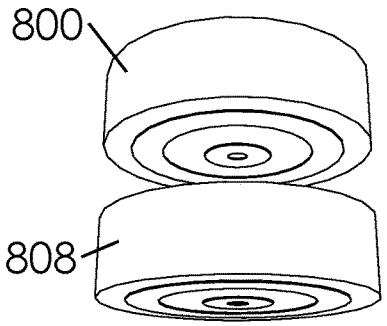
Figure 8C:
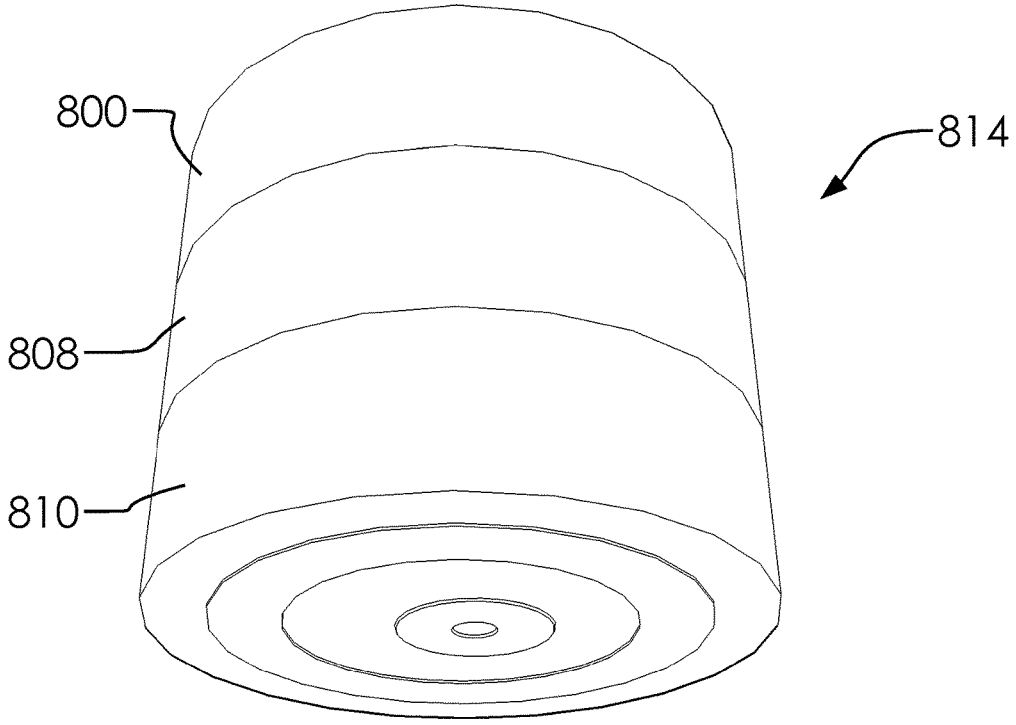

FIGS. 8A, 8B and 8C illustrate three perspective lower views of a candle segment 800 and a second segment 808. In one embodiment, said candle segment 800 can comprise an adhesive set 802 having an adhesive 804 and an adhesive sticker 806. In one embodiment, said adhesive 804 can attach to a bottom surface 803 of said candle segment 800. In one embodiment, said adhesive 804 can be protected by said adhesive sticker 806 as is well known in the art. In one embodiment, said adhesive 804 can attach said candle segment 800 to said second segment 808 or any other candle segment by: exposing said adhesive 804, pressing said adhesive 804 between said candle segment 800 and said second segment 808. In one embodiment, exposing said adhesive 804 can comprise removing said adhesive sticker 806. In one embodiment, said candle segment 800 can be used in a layered candle 814, as illustrated with said candle segment 800, said second segment 808 and a third segment 810.

Figure 9A:
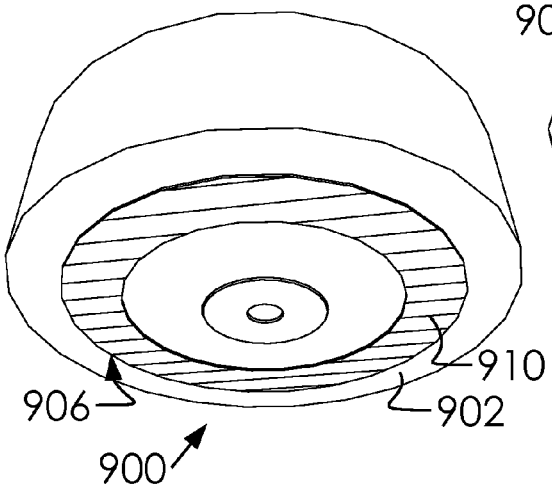
FIGS. 9A, 9B and 9C illustrate a perspective lower view and a perspective overview of a candle segment, and a perspective overview of said candle segment attaching to a second segment.
Figure 9B:
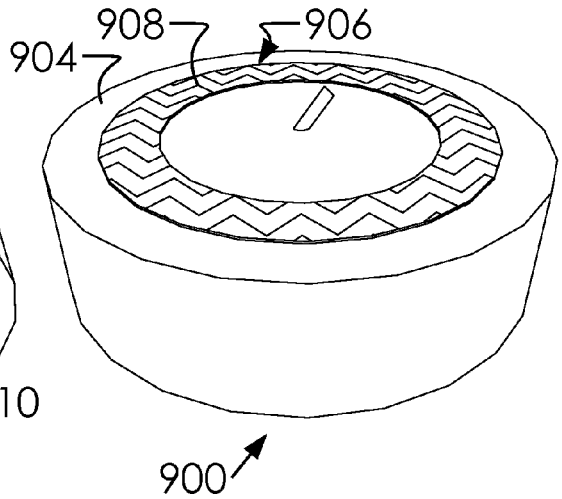
Figure 9C:
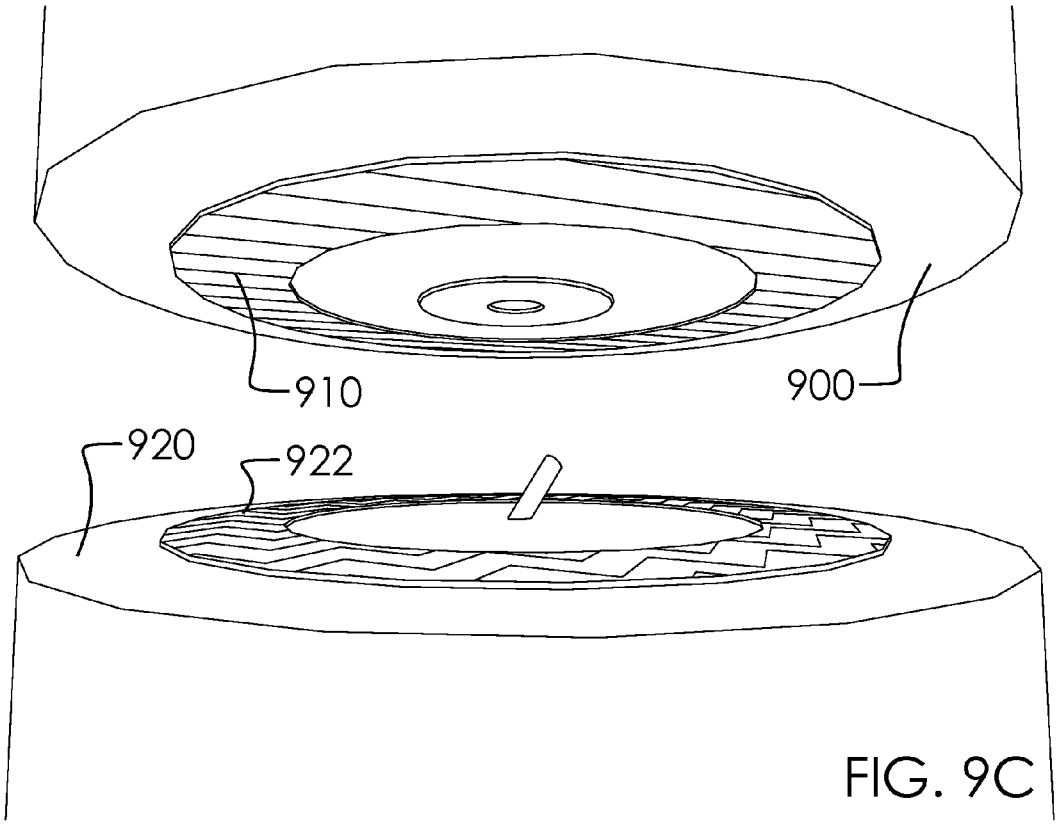

FIGS. 9A, 9B and 9C illustrate a perspective lower view and a perspective overview of a candle segment 900, and a perspective overview of said candle segment 900 attaching to a second segment 920. In one embodiment, said candle segment 900 can comprise a top surface 902 and a bottom surface 904. In one embodiment, said candle segment 900 can comprise a hook-and-loop set 906 having a hook portion 908 (illustrated as a zigzag pattern) and a loop portion 910 (illustrated as a hatch pattern). In one embodiment, said hook portion 908 can attach to said bottom surface 904 and said loop portion 910 can attach to said top surface 902. In one embodiment, said hook-and-loop set 906 can be used to attach said candle segment 900 to said second segment 920. For example, in one embodiment, said second segment 920 can comprise a hook portion 922 (similar to said hook portion 908) which can attach to said loop portion 910 of said candle segment 900.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A layered candle comprising:

said layered candle comprising a two or more candle segments;

said two or more candle segments comprise at least a first candle segment and a second candle segment;

said two or more candle segments each comprise a candle wick, a top surface, a bottom surface, and a height;

a bottom surface of said first candle segment is configured for attaching a top surface of said second candle segment;

each of said two or more candle segments further comprise a tab;

said candle wick attaches to said tab at said bottom surface of each of said two or more candle segments;

said tab comprises a firewall between said two or more candle segments;

each of said two or more candle segments consists of said tab at said bottom surface, said candle wick attached to said tab, and said candle wick penetrating through said top surface;

said first candle segment comprises a top segment of said layered candle;

said layered candle is configured to burn said candle wick of said first candle segment with a flame until said flame reaches said tab of said first candle segment, and extinguish said flame by blocking continued burning at said tab of said first candle segment; and said layered candle is configured to receive a new flame with said candle wick of said second segment after removing said tab of said first candle segment.

2. The layered candle of claim 1 wherein, said compositions of said two or more candle segments are different.

3. The layered candle of claim 2 wherein, said two or more candle segments each comprise a burn time, and said burn time of said two or more candle segments vary based on said height and said composition.

4. The layered candle of claim 1 wherein, said two or more candle segments are configured for rearrangement on one another.

5. The layered candle of claim 1 wherein, said top surface of each of said two or more candle segments have a concave shaped surface and said bottom surface of said two or more candle segments have a convex shaped surface;

further wherein, said bottom surface of said first candle segment is configured for attaching to said top surface of said second candle segment by fitting a portion of said concave shaped surface of said second candle segment into a portion of said convex shaped surface of said first candle segment.

6. The layered candle of claim 5 wherein, said top surfaces and said bottom surfaces of said two or more candle segments are similarly angled to permit nesting when said two or more candle segments are stacked on one another.

7. The layered candle of claim 5 wherein, said layered candle further comprises a base segment;

a top surface of said base segment is adapted to receive a bottom surface of said two or more candle segments; and a bottom surface of said base segment comprises a flat surface.

8. The layered candle of claim 1 wherein, said two or more candle segments comprise a one or more protruding studs and a one or more stud cavities; and further wherein, said bottom surface of said first candle segment is configured for attaching said top surface of said second candle segment by inserting said one or more protruding studs into said one or more of a stud cavities.

9. The layered candle of claim 8 wherein, said one or more protruding studs are on said top surface of said two or more candle segments; and said one or more stud cavities are in said bottom surface of said two or more candle segments.

10. The layered candle of claim 8 wherein, said one or more protruding studs are on said bottom surface of said two or more candle segments; and said one or more stud cavities are in said top surface of said two or more candle segments.

11. The layered candle of claim 8 wherein, said one or more protruding studs and said one or more stud cavities are equal in number and location on said candle segments.

12. The two or more candle segments of claim 1 wherein each of said two or more candle segments comprise a hook-and-loop set having a hook portion and a loop portion;

said hook portion and said loop portions begin attached on opposite sides of said each of said two or more candle segments at a top surface and a bottom surface; and further wherein, said bottom surface of said first candle segment is capable of attaching said top surface of said second candle segment by arranging said hook-and-loop set between each of said two or more candle segments of said layered candle.

13. A layered candle manufacturing method comprising:

attaching a first end of an extended candle wick around a rod, attaching a second end of said extended candle wick to a post of a candle tab, placing said candle tab at a bottom of a container while keeping said rod with said first end of said extended candle wick at a top of said container, pouring a liquid wax into said container, molding said a first candle segment form said liquid wax, said candle tab and said wick, and removing said first candle segment from said container when said liquid wax solidifies;

and wherein, said first candle segment comprises a top surface and a bottom surface, said first candle segment comprises a portion of a two or more candle segments comprising a layered candle, and a bottom surface of said first candle segment is formed so as to nest into a top surface of a second candle segment among said two or more candle segments said two or more candle segments each comprise a candle wick, a top surface, a bottom surface, and a height;

said candle wick comprises a portion of said extended candle wick;

a bottom surface of said first candle segment is configured for attaching a top surface of said second candle segment;

each of said two or more candle segments further comprise a tab;

said candle wick attaches to said tab at said bottom surface of each of said two or more candle segments;

said tab comprises a firewall between said two or more candle segments;

each of said two or more candle segments consists of said tab at said bottom surface, said candle wick attached to said tab, and said candle wick penetrating through said top surface;

said first candle segment comprises a top segment of said layered candle; and said layered candle is configured to burn said candle wick of said first candle segment with a flame until said flame reaches said tab of said first candle segment, and extinguish said flame by blocking continued burning at said tab of said first candle segment; and said layered candle is configured to receive a new flame with said candle wick of said second segment after removing said tab of said first candle segment.

14. The layered candle manufacturing method of claim 13 wherein making molding said first candle segment further comprises:

molding a convex surface into said bottom surface of said first candle segment with said bottom of said container and molding a concave surface into said top surface of said first candle segment with an upper cast.

15. The layered candle manufacturing method of claim 13 wherein making molding said first candle segment further comprises:

molding a one or more protruding studs into said bottom surface of said first candle segment with said bottom of said container and molding a one or more of a stud cavities into said top surface of said first candle segment with an upper cast.

16. The layered candle manufacturing method of claim 13 wherein making molding said first candle segment further comprises:

molding a one or more of a stud cavities into said bottom surface of said first candle segment with said bottom of said container and molding a one or more protruding studs into said top surface of said first candle segment with an upper cast.

17. A layered candle comprising:

said layered candle comprising a two or more candle segments;

said two or more candle segments comprise at least a first candle segment and a second candle segment;

said two or more candle segments each comprise a candle wick, a top surface, a bottom surface, and a height;

a bottom surface of said first candle segment is configured for attaching a top surface of said second candle segment;

said two or more candle segments comprise an adhesive set between each of said two or more candle segments; further wherein, said bottom surface of said first candle segment is configured for attaching said top surface of said second candle segment by holding said two or more segments of said layered candle together with said adhesive.

18. The layered candle of claim 17 wherein:

said adhesive set comprises an adhesive and an adhesive sticker;

said adhesive adheres to said bottom surface of each of said two or more candle segments;

said adhesive sticker protects said adhesive prior to use; and said two or more candle segments are configured to adhere to one another by removing said adhesive sticker from said first candle segment and pressing said adhesive of said first candle segment into a top surface of said second candle segment.

* * * * *